US005601036A

United States Patent [19]

Kieser et al.

[11] Patent Number: 5,601,036

[45] Date of Patent: Feb. 11, 1997

[54] ADJUSTABLE TABLE

[76] Inventors: Joyce R. Kieser; Henry S. Kieser, both of 46 Fox Den Rd., W. Simsbury, Conn. 06092

[21] Appl. No.: 421,538

[22] Filed: Apr. 13, 1995

[51] Int. Cl.[6] ..... A47B 9/00

[52] U.S. Cl. ..... 108/107; 108/148

[58] Field of Search ..... 108/4, 10, 110, 108/107, 156, 158, 144, 148, 180, 193

[56] References Cited

U.S. PATENT DOCUMENTS 3,295,695 1/1967 Carmstrom ..... 108/144

FOREIGN PATENT DOCUMENTS 0264182 9/1913 Germany ..... 108/107

2504524 8/1976 Germany ..... 108/109

0050041 8/1910 Switzerland ..... 108/107

0013498 7/1910 United Kingdom ..... 108/14 H

*Primary Examiner*—Peter M. Cuomo

*Assistant Examiner*—Gerald A. Anderson

*Attorney, Agent, or Firm*—H. Samuel Kieser

[57] ABSTRACT

An adjustable table including a table top supported by support members removably attached to the table top by a plurality of removable fasteners. The top may be adjusted in height and may be attached to the support members in either a horizontal or tilted position. The support members are provided with a series of fastener receiving apertures in a configuration to provide a plurality of sets of apertures. Each set of apertures provides for a given height of the table top. A plurality of second sets of apertures provides for the tilting of the table.

13 Claims, 5 Drawing Sheets

ADJUSTABLE TABLE

BACKGROUND OF THE INVENTION

1. Field of the Invention

This invention relates generally to an adjustable table, and, more particularly, to a table that is vertically adjustable to vary the height of the work surface and also one in which the work surface is tillable.

2. Background

The availability of portable computers such as laptops and notebooks has resulted in an increased number of people using such computers at home or while traveling and away from their office, either as an extension of their employment duties or for their own use. As such computers are small and readily portable, there is no need for a large desk to be dedicated as a worksite to contain the computer and peripheral equipment. Such computers may be used anywhere in the house, from dinning rooms and kitchens to recreation rooms and dens. Also while traveling, they are used in the hotel or motel room.

With the portability of such computers, and their use out of a pure office environment, they are commonly used on an available surface, such as a kitchen or dining room table, a card table or simply placed in the user's lap. As a result, the computer is not necessarily at a height which is comfortable to the user, especially in the case of a relatively tall or short person. Additionally, as many of the laptop or notebook computers do not have any means to tilt the keyboard, the angle of the work surface of a table may not be at the angle to provide the most comfort for user. Further, the available work surface may not be in a location which is desirable. The use of the kitchen table when the kitchen is being used for other purposes is probably not conducive to a concentrated work effort.

SUMMARY OF THE INVENTION

In view of the above, it is an object of the present invention to provide an improved table in which the height of the table top or work surface may be adjusted.

It is a further object of the present invention to provide an improved table in which the table top or work may be tilted.

It is yet another object of the present invention to provide an improved table having a table top or work surface which is adjustable in height and titltable and which is relatively light so that it may be easily moved from location to location.

Still another object of the present invention is the provision of a table which may be assembled easily, and easily disassembled for storage or other purposes.

These and other objects of the present invention may be achieved in accordance with the present invention through the provision an adjustable table which comprises a table top having opposed side portions, a pair of support members, one removeably affixed to each side portion of said table top, and removable fastener elements affixing each support member to its respective side portion. The support members have a plurality of vertically spaced sets of locations for receiving the removable fastener elements. The table top has fastener attaching elements for releasably receiving the fastener elements to affix said top to each said support member, the fastener elements being positionable in one set of locations for affixing said table top to the support members at one given vertical height and being positionable in another set of locations to affix the table top to the support members at a different vertical height of the top.

According to a further feature of the present invention, each of the support members further includes a plurality of vertically spaced, tilted aligning sets of locations for receiving said removable fastener elements, said fastener elements being positionable in one tilted aligning set of locations for affixing the table top to the support members in a tilted position at one given vertical height of the top and being positionable in another tilted aligning set of locations to affix the table top to the support members in a tilted position at a different vertical height of the top.

BRIEF DESCRIPTION OF THE DRAWINGS

The present invention may be better understood by reference to the following detailed description and to the accompanying drawings in which.

DETAILED DESCRIPTION

Figure 1:
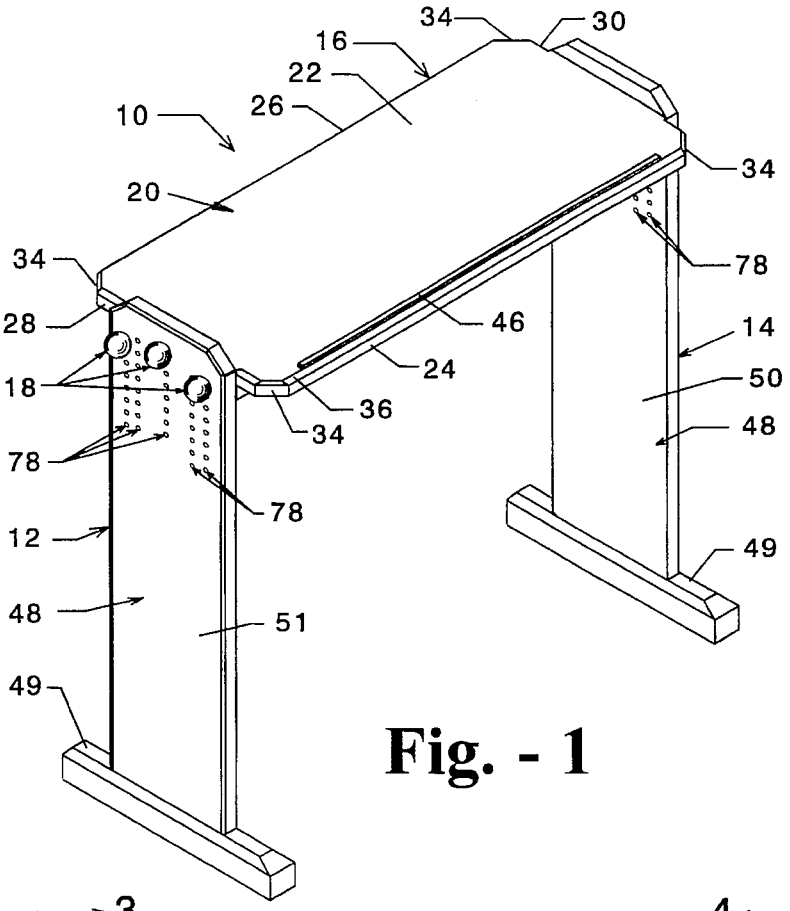
FIG. 1 is an isometric view of a table constructed in accordance with the present invention.

Referring to the drawings, and particularly as viewed FIG. 1, a table 10 embodying the principles of the present invention may include a left-hand leg or vertical support member 12, a right-hand leg or vertical support member 14, and a table top or work surface 16 connected to and supported by the two legs 12 and 14. A plurality of fasteners 18 extend through the legs 12 and 14 into the table top 16 to provide the connection therebetween. Preferably, the legs 12 and 14 and the table top 16 are fabricated from wood which permits a wide range of finishing techniques to be applied to their surfaces.

More specifically, the table top or work surface 16 comprises an elongated main member 20 having a planar top surface 22, a front surface 24, a rear surface 26, two spaced planer end surfaces 28 and 30, and a bottom surface 32. The corners of the main member 20 of the table top 16 may be angled as indicated at 34 or rounded or otherwise profiled to provide a decorative appearance. Additionally, the upper edge 36 of the top may be chamfered as shown, rounded or otherwise provided with a shaped edge portion to also add to the decorative appearance of the table.

Figure 7:
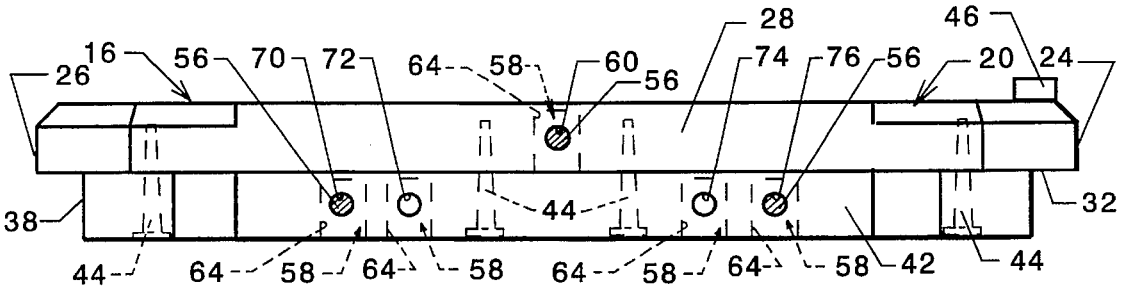
FIG. 7 is an end view of the table top or work surface.

The table top 16 may also include a pair of brace members 38 and 40 attached to the bottom surface 32 of the main member 20. Each of the brace members 38 and 40 includes a planar end surface 42 which is positioned co-planar with its respective planar end surface 28 or 30 of the main member 20 of the table top 16. As shown in FIG. 7, the brace members 38 and 40 are each attached to the bottom surface 32 of the main member 20 of the top 16 by a plurality of counter-sunk wood screws 44 and/or gluing, or by other suitable means of attachment. As will be noted in FIG. 2, each brace 38 and 40 extends a relatively short distance from its respective end surface 28 or 30 of the main member 20 of the top 16 toward the opposite end surface 28 or 30 so that there is more free space below the bottom surface 32 of the main member 20 to provide clearance for the user. An elongated strip or retainer 46 may be attached to the top surface 22 of the main member 20 of the top 16 adjacent the edge of the front surface 24 as shown.

Figure 2:
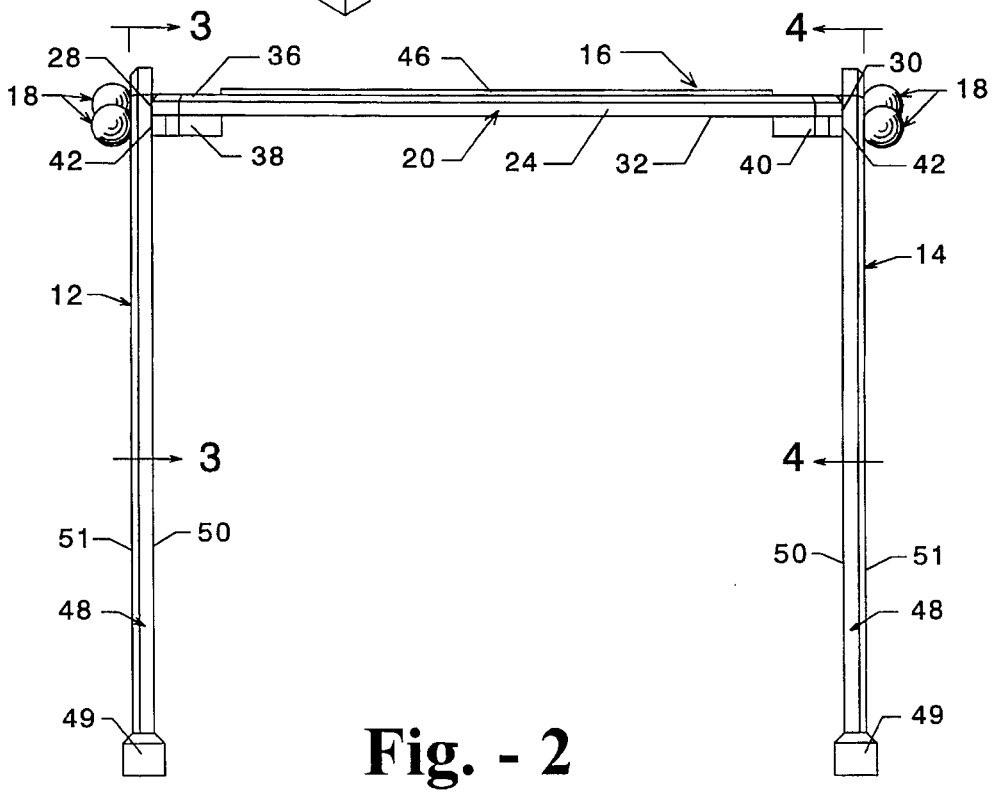
FIG. 2 is a front elevational view of the table of FIG. 1.

Each of the legs, or vertical support members, 12 and 14 may include a vertically extending support portion 48 which is attached to an elongated, relatively narrow, base portion or foot 49. Each base portion 49, as shown in FIGS. 1 and 2, has its axis of elongation extending transversely to the axis of the length of the top. The support portion 48 and base portion 49 of each of the legs 12 and 14 are preferably fabricated from wood and are secured together by any suitable means such as a glued mortise and tendon joint and/or screws to provide a rigid connection. The support portion 48 of each leg 12 and 14 may include a generally planar inside surface 50 and a decorative outside surface 51.

Figure 8:
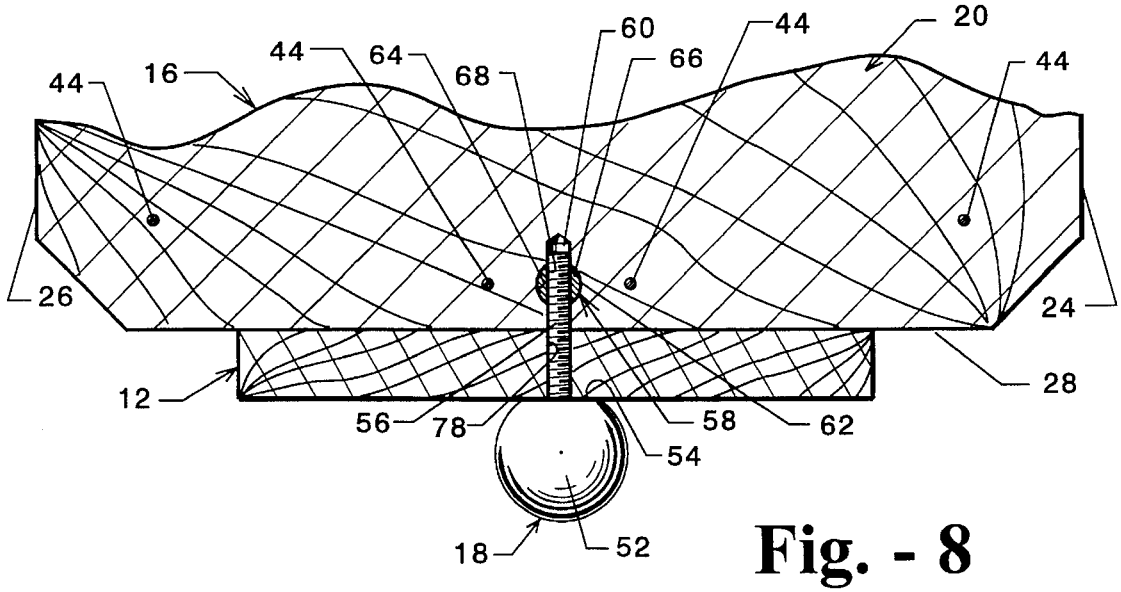
FIG. 8 is a horizontal sectional view taken along the line 8—8 of FIG. 3.
Figure 9:
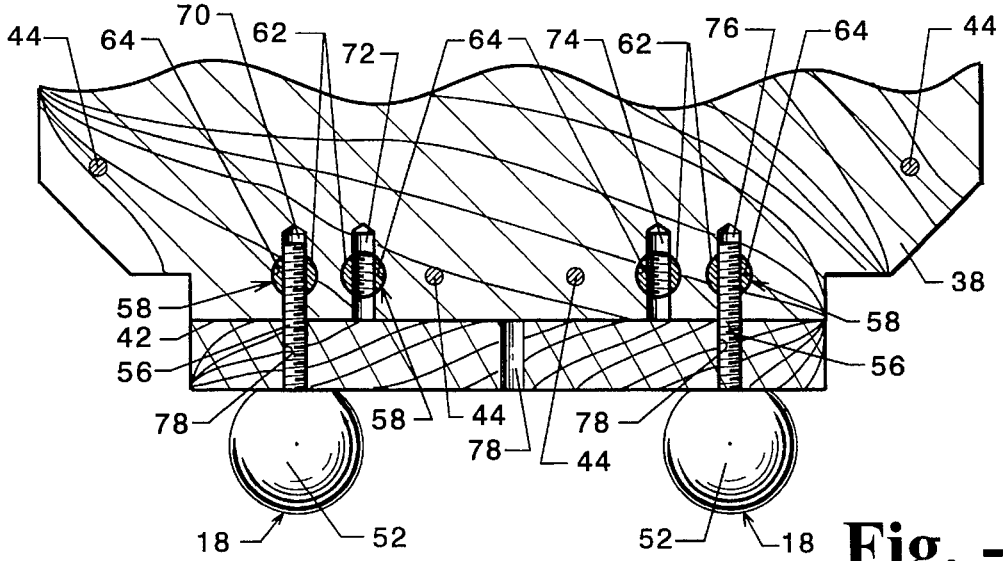
FIG. 9 is a horizontal sectional view taken along the lines 9—9 of FIG. 3.

The table top 16 is attached to the support portion of the legs by means of the fasteners 18. The fasteners 18 may comprise male fasteners such as fastening knobs, as shown in FIGS. 8 and 9, each of which includes a generally spherical-shaped knob portion 52 having a flat face 54 adapted to abut against the outside surface of a leg 12 or 14. A threaded male fastening element 56 is attached to, and extends from, the face 54 of each knob portion 52. The threads on the male fastening element may be machine screw threads, adapted for connection to a threaded female fastener 58 attached to the top 16.

Referring to FIGS. 7 and 8, a bore 60 extends into each end surface 28 and 30 of the main member 20 of the table top 16 The center point of the axis of each bore 60 is positioned in the center of its respective end surface 28 or 30, equally spaced from the from the front 24 and rear 26 surfaces. The female fastener 58 is mounted in the main member 20 of the top 16 in communication with the bore 60 as shown. The female fastener 58 may be of any suitable type which can receive the male fastener element 56 of the fastener 18. One type of female fastener 58 suitable for use in connection with the present invention is a cross-dowel 62 which may be mounted in a bore 64 extending into the bottom surface 32 of the main member 20 of the top 16 and which has a cylindrical body 66 with a threaded aperture 68 extending transversely therethrough. The axis of the bore 64 in the bottom surface 32 of the main member 20 in which the cross-dowel is mounted intersects the axis of the bore 60 in the end surface 28 or 30. The bore 64 is of a proper predetermined depth so that when the cross-dowel 62 is tightly fit into the bore 64, the axis of the threaded aperture 68 in the cross-dowel is positioned co-axial with the axis of the bore 60 in the end surface 28 or 30 of the main member 20 of the top 16. Other types of female fasteners may be used such as threaded inserts which may be threaded into the bore 60 in the end surface 28 and 30 of the main member 20 of the table top 16 and which are internally threaded to receive the threaded portion of the male fastener 18.

A plurality of bores 70, 72, 74 and 76 are provided in the end surface 42 of each of the brace members 38 and 40 as shown in FIGS. 7 and 9. Two of the bores 70 and 72 are positioned on one side of a plane perpendicular to the top surface 22 of the main member 20 and which passes through the axis of the bore 60 in each end surface 28 and 30 of the main member 20 of the top 16. The other two bores 74 and 76 are positioned on the other side of that plane. This arrangement provides two outside bores 70 and 76 and two inside bores 72 and 74. The axes of the bores 70, 72, 74 and 76 are coplanar, and extend parallel to the axis of the bore 60 in the end surface 28 or 30 of the main member 20 of the top 16. Each of the bores 70, 72, 74 and 76 in the brace members 38 and 40 have associated therewith a female fastener 58 such a cross-dowel 62 having an internally threaded aperture 68 coaxial with its respective bore 70, 72, 74 and 76 as described in connection with the bore 60 in the main member of the top 16.

Figure 3:
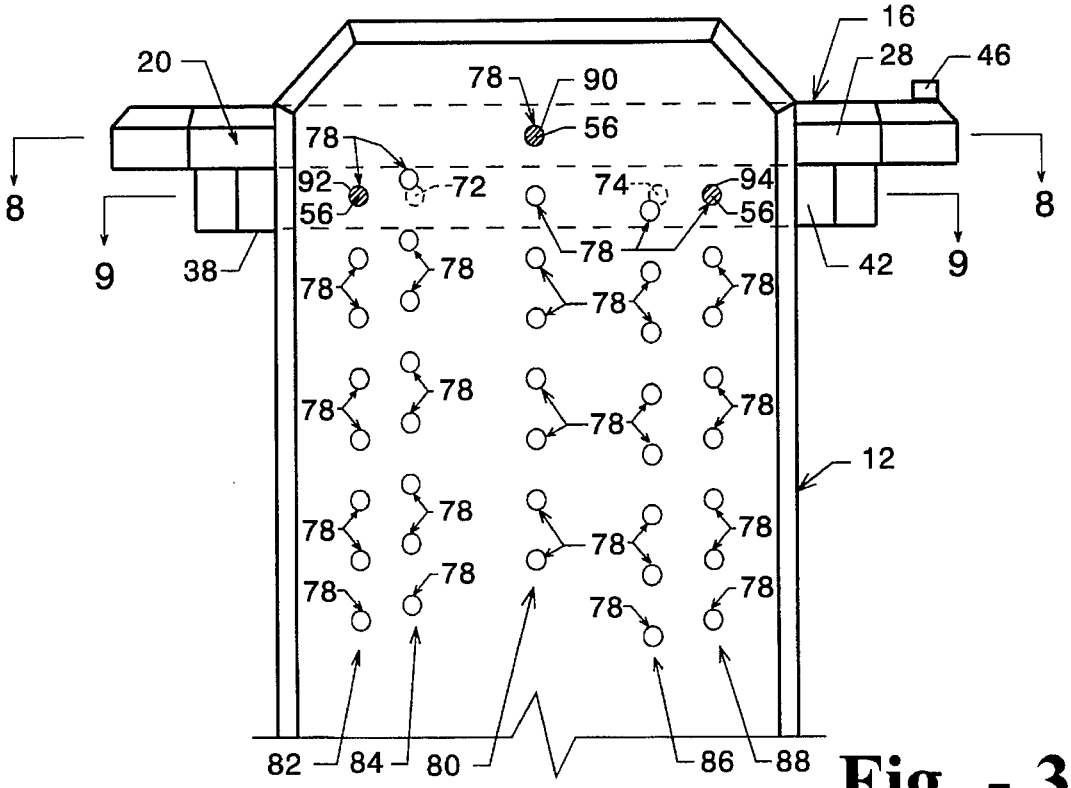
FIG. 3 is partial side view, partially in section, taken along the line 3—3 of FIG. 2.
Figure 4:
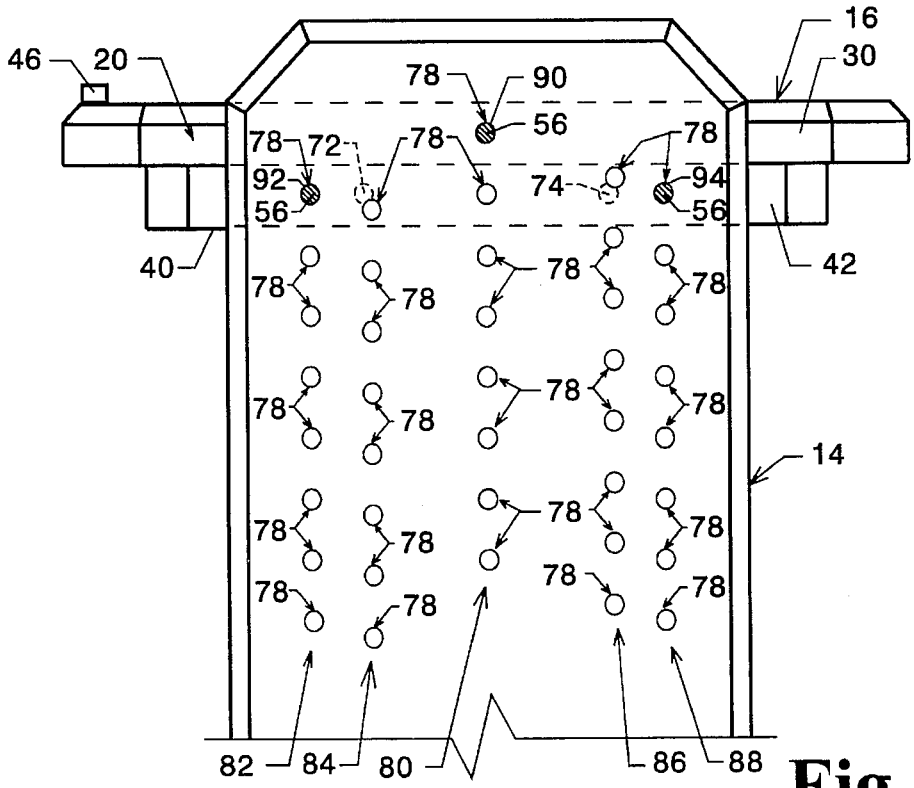
FIG. 4 is a partial side view, partially in section, taken along the lines 4—4 of FIG. 2.

The support portion 48 of each of the legs 12 and 14 is provided with a series of holes or apertures 78 in its upper area through which the male fastener elements 56 of the fasteners 18 are adapted to extend. As shown particularly in FIGS. 3 and 4, there are five columns 80, 82, 84, 86 and 88 of vertically spaced holes 78 as indicated by the arrows. A center column 80 extends along the vertical center axis of each leg 12 and 14, with two columns 82 and 84 spaced on one side of the center column 80 forming a left outside column 82 and a left intermediate column 84. Two columns 86 and 88 are spaced on the other side of the center column 80 forming a right intermediate column 86 and a right outside column 88 as viewed in FIG. 3. The holes or apertures 78 in the legs 12 and 14 are located so that the bores 60, 70, 72, 74 and 76 in the end surfaces 28, 30 and 42 of the top 16 will align with a given set of holes 78 depending upon the desired height of the table top 16 and whether the top 16 is positioned in a horizontal position or is tilted as will be explained below. The left and right outside columns 82 and 88 are horizontally spaced from the center column 80 a distance equal to the distance, in a plane parallel to the top surface 22 of the table top 16, of the outside bores 70 and 76 from the plane, perpendicular to the top surface 22, in which the bores 60 in the end surfaces 28 and 30 of the main member 20 of the top 16 are located.

The relationship of the holes 78 in the legs 12 and 14 with the bores 60, 72, 74, 76 and 78 in the table top 16 is shown particularly in FIGS. 3–6. A hole 78 in the center column 80 of each leg 12 or 14 is adapted to be aligned with the bore 60 in its respective end surface 28 or 30 of the main member 20 of the table top 16, both with the table top 16 in its horizontal position and when the top 16 is tilted. The particular hole 78 in the center column 80 which is selected will determine the height of the table top 16. A hole 78 in both the right and left outside columns 82 and 88 will be aligned with the right and left outside bores 70 and 76 in the brace 38 or 40 when the top 16 is positioned horizontally. A hole 78 in the left inside column 84 and the right inside column 86 will be in alignment with the inside bores 72 and 74 in the brace members 38 and 40 when the table top 16 is tilted.

Figure 5:
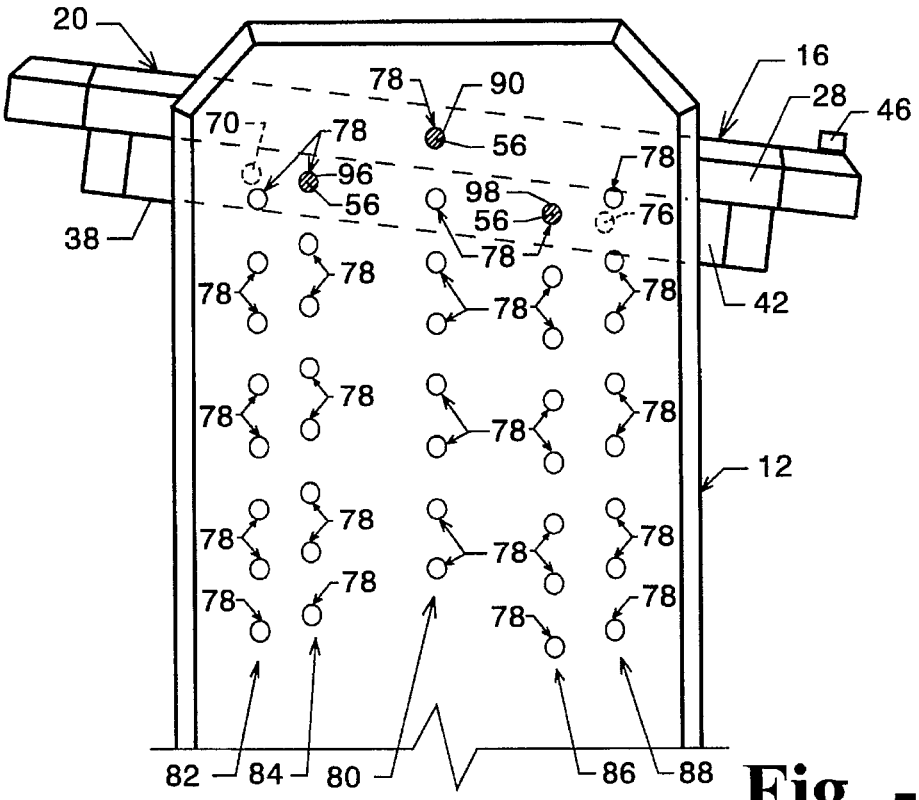
FIG. 5 is a view similar to FIG. 3, but showing the table top, or work surface, in the tilted position.
Figure 6:
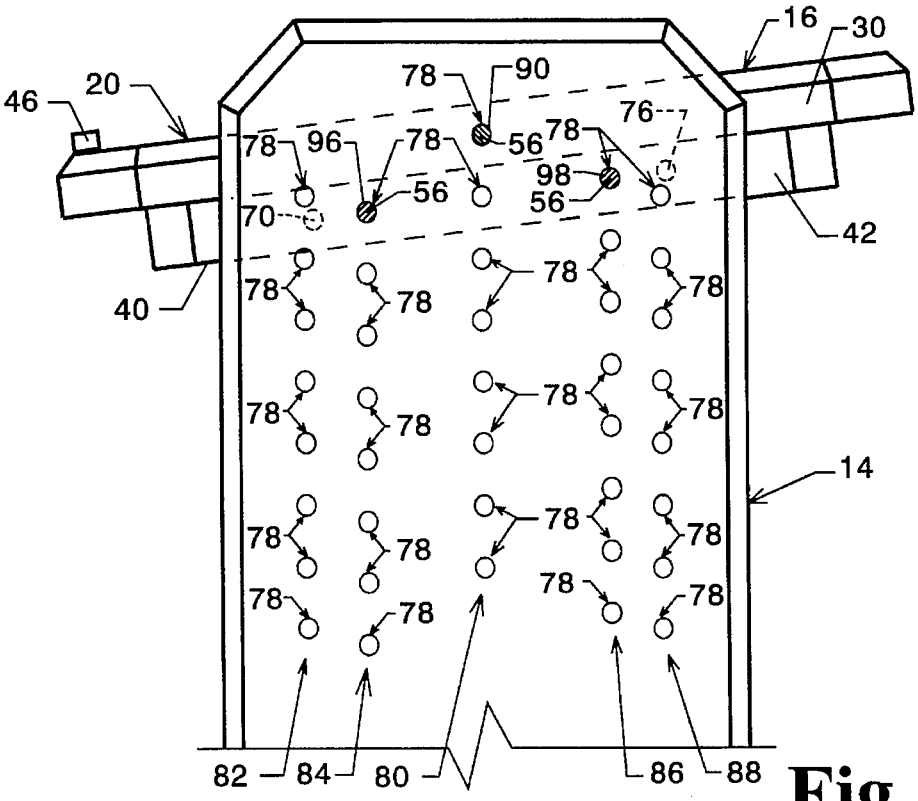
FIG. 6 is a view similar to FIG. 4, but showing the table top, or work surface, in a tilted position.

For example, if the upper-most center hole 90 of each leg 12 and 14 is aligned with the bore 60 in its associated end surface 28 or 30 of the main member of the table top 16, the top 16 will be at its highest level as shown in the drawings. With the upper-most hole 90 so aligned, when the table top 16 is in its horizontal position, the upper-most hole 92 in the left outside column 82 of holes 78 and the upper-most hole 94 in the right outside column 88 of holes 78 will be in alignment with the outside bores 70 and 76 respectively in the brace members 38 and 40. When the table top 16 is in its tilted position as shown in FIGS. 5 and 6, and the uppermost center hole 90 in alignment with the bore 60 in the table top 16, the uppermost holes 96 and 98 in the left and right intermediate columns 84 and 86 respectively will be in alignment with the inside bores 72 and 74 respectively. This enables male fastener member 18 to be inserted through the holes 96 and 98 into the bores 72 and 74 respectively for engaging the female fastener.

Figure 10:
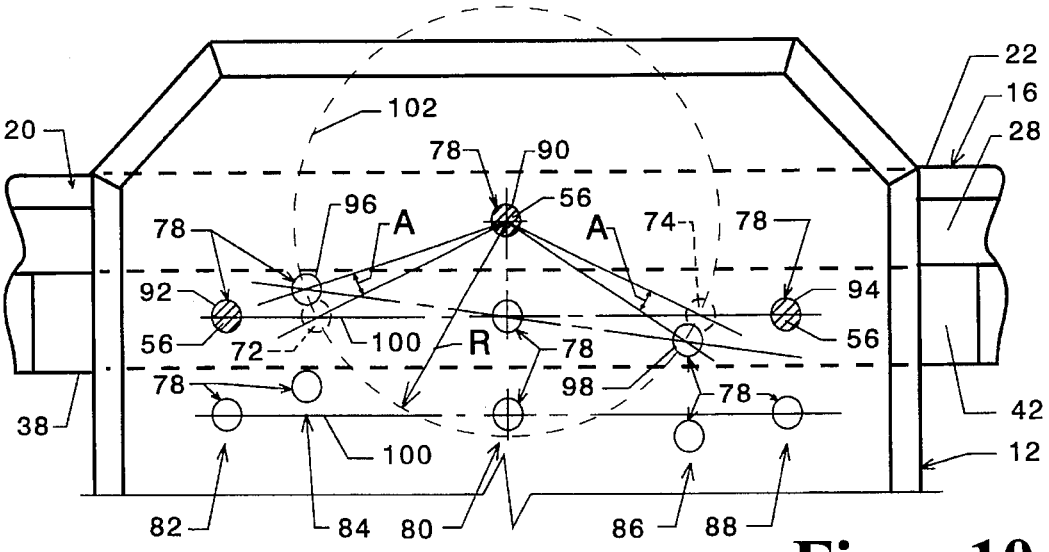
FIG. 10 is an enlarged partial side view, taken in the same direction as FIG. 3, and showing the relationship of the fastener receiving holes in the left leg and top.
Figure 11:
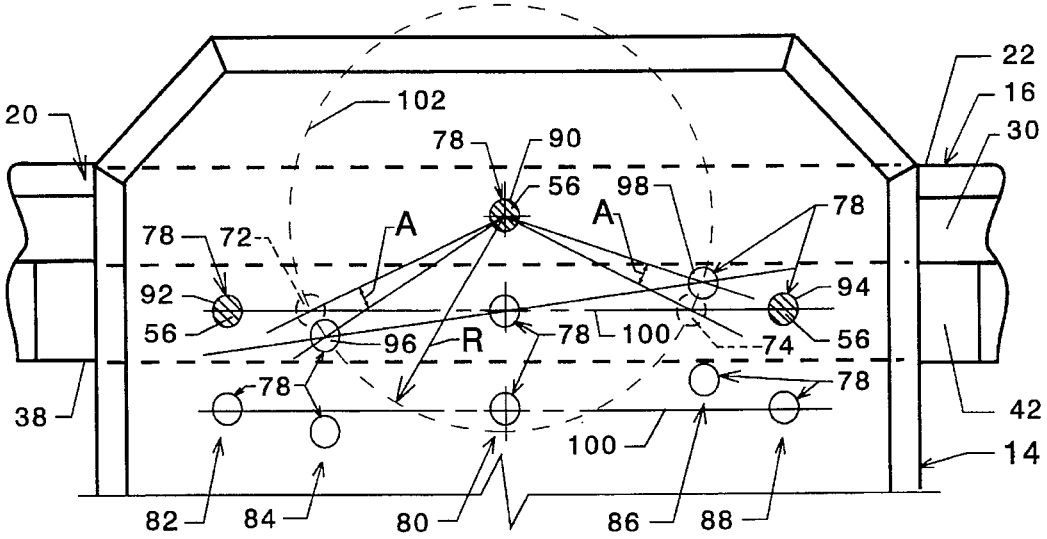
FIG. 11 is an enlarged partial side view, taken in the same direction as FIG. 4, and showing the relationship of the fastener receiving holes in the right leg and top.

Vertically adjacent holes 78 in the center column 80 are vertically spaced apart a distance equal to the desired incremental step of the height adjustment. As will be noted from FIGS. 3 and 4, for each hole in the center column 80 that is selected for alignment with the bore 60 in the main member 20 of the top 16 for insertion of the fastening 56, there is one hole 78 in the left outside column 82 and one hole 78 in the right outside column 88 associated with that particular center hole 78 which will align with the outside bores 70 and 76 respectively, permitting a fastening element to be inserted therethrough to connect the tale top 16 in the horizontal position at the height dictated by the center hole. As shown in FIGS. 10 and 11, the horizontal position associated holes 78 are in a horizontal row 100 spaced vertically downward from the horizontal plane passing through the selected center hole 78 by a distance equal to the vertical distance between the horizontal plane passing through the bore 60 in the top surface and the horizontal plane passing through the bores 70, 72, 74 and 76 in the brace members 38 and 40 (when the top is horizontal). Accordingly, for each hole 78 in the center column 80, there is a row 100 containing a hole in the left outside column 82 and a hole 78 in the right outside column 88 that is associated with that center hole.

As will be noted from FIGS. 5 and 6, for each hole in the center column 80 that is selected for alignment with the bore 60 in the main member 20 of the top 16 for insertion of the fastening 56, there is one hole 78 in the left intermediate column 84 and one hole 78 in the right intermediate column 86 associated with that particular center hole 78 which will align with the inside bores 72 and 74 respectively, permitting a fastening element to be inserted therethrough to connect the table top 16 in the tilted position at the height dictated by the selected center hole. As shown in FIGS. 10 and 11, the axes of the tilt position associated holes 78 in the intermediate columns 84 and 86 are located along the circumference of a circle 102 which has its center at the axis of the selected center hole 90 (the center of rotation of the top 16) and which has a radius "R" equal to the distance from the axis of the bore 60 to the axes of the inside bores 72 and 74 in the brace members 38 and 40 of the table top 16. The axes of the associated holes 78 in the left intermediate column 84 and the right intermediate column 86 are spaced along the circumference of the circle 102 by an angle "A" from the point where the circumference of the circle 102 intersects the horizontal plane containing the axes of the horizontal position associated holes 78 in the left and right outside columns 82 and 88 respectively. The angle "A" is the desired angle at which its is desired to tilt the top 16, and is preselected for a given table design. The angle "A" is preferably between about 5 and about 15 degrees and more preferably between about 6 to about 10 degrees.

Specifically, regarding the holes 78 in the intermediate columns 84 and 86 of the left leg 12, referring to FIG. 10, as the table top 16 in that view will be tilted in a clock-wise direction, the axes of the holes 78 in the left intermediate column 84 are offset upwardly, in a clockwise direction along the circumference of the circle 102 through the angle "A", from the intersection adjacent the left column 82 of the circumference of the circle 102 with the horizontal plane in which the axes of the associated holes in the outside columns 82 and 88 are located. The holes 76 in the right intermediate column 86 are offset downwardly, also in a clockwise direction along the circumference of the circle 102 through the angle "A", from the intersection adjacent the right column 88 of the circumference of the circle 102 with the horizontal plane in which the axes of the associated holes in the outside columns 82 and 88 are located. This pattern is repeated for each of the center holes 76 in the left leg 12.

The arrangement of the holes 78 in the right leg 14, when viewing that leg from the right side of the table, is a mirror image of the holes in the left leg, as indicated by the position of the holes in FIGS. 10 and 11. Thus, when viewed as shown in FIG. 11, the arrangement of the holes in the left and right intermediate columns 84 and 86 is different from that of the left leg 12 shown in FIG. 10. As the table top 16 in that view will be tilted in a counter clockwise direction, the axes of the holes 78 in the left intermediate column 84 are offset downwardly, in a clockwise direction along the circumference of the circle 102 through the angle "A", from the intersection adjacent the left column 82 of the circumference of the circle 102 with the horizontal plane in which the axes of the associated holes in the outside columns 82 and 88 are located. The holes 78 in the right intermediate column 86 are offset upwardly, also in a counter clockwise direction along the circumference of the circle 102 through the angle "A", from the intersection adjacent the right column 88 of the circumference of the circle 102 with the horizontal plane in which the axes of the associated holes in the outside columns 82 and 88 are located. This pattern is repeated for each of the center holes 78 in the right leg 14.

Thus, the arrangement of the apertures or holes 78 in each leg 12 and 14 provide for a plurality of vertically spaced horizontal aligning sets of locations of holes or apertures 78 for receiving the fasteners 18 to attach to the female fasteners 58 for securing the table top 16 to the legs 12 and 14 with the top 16 in the horizontal position. Each such set provides for a different vertical height of the table top. The arrangement also provides for a plurality of vertically spaced tilted aligning sets of locations of holes or apertures 78 for receiving the fasteners 18 for securing the table top 16 to the legs 12 and 14 with the top 16 in a tilted position. Each tilted aligning set providing for a different vertical height of the top 16.

For example, referring to FIGS. 10 and 11, the hole 90 in the center column 80 and the holes 92 and 94 in the left and right outside columns 82 and 88 respectively, constitute a first set of horizontal aligning holes 78 which secure the top in a horizontal position at the maximum vertical height. The holes 78 in each of the columns 80, 82 and 88, immediately below the holes 90, 92 and 94 constitute a second horizontal aligning set of holes 78 which may be used to secure the table top in a horizontal position at a different vertical height.

The hole 90 in the center column 80 and the holes 96 and 98 in the left and right intermediate columns 84 and 86 respectively, constitute a first set of tilted aligning holes 78 which secure the top 16 in its tilted position at the maximum vertical height. The holes 78 in each of the columns 80, 84 and 86, immediately below the holes 90, 96 and 98, constitute a second set of holes 78 which may be used to secure the top 16 in the tilted position at a different vertical height.

As the fasteners 18 constitute removable connectors, the table 10 may be easily broken down into three basic pieces, the top 16 and the two legs 12 and 14, plus the fasteners 18 for transporting and storage. The fastener 18 may be temporarily attached to the table top 16 for storage.

When it is desired to assemble the table 10 with the top 16 horizontal, a hole 78 in the center column 80 of each leg 12 and 14 corresponding to the desired height of the table top 16 is selected and aligned with the bore 60 in the respective end surfaces 28 or 30 of the main member 20 of the top 16. The threaded fastening elements 56 of the fastener 18 may then be inserted through the holes 78 into the respective bores 60 and threaded into the female fasteners 58. With the these fasteners 18 loosely engaging the female fastener 58, the table top 16 may be positioned horizontally so that the outside bores 70 and 76 in the ends surface 42 of each brace member 38 and 40 are aligned with a respective hole 78 in the left and right outside columns 82 and 88 of holes 78 in each leg 12 and 14. The threaded fastener element 56 may be inserted through these holes into the bores 70 and 76 and into engagement with the female fasteners 58. After all the fasteners 18 are partially attached, all the fasteners may be tightened to securely hold the planar inner surface 50 of each leg 12 and 14 tightly against the respective planar end surfaces 28 and 30 of the main member 20 of the top 16 and against the planar end surface 42 of its respective brace member 38 or 40. As the center fastener 18 is positioned vertically above the other two fasteners 18 which are on either side thereof, the location of the clamping force applied by the fasteners 18 forcing the legs 12 and 14 against the top 16 are at the points of a triangle, which helps to increase the stability of the assembled table 10.

If it is desired to tilt the table top 16, the fasteners 18 associated with the holes 78 in the center column 80 of each leg 12 and 14 may be loosened, while the fastening knobs 18 associated with the holes 78 in the right and left outside columns 82 and 88 of each leg 12 and 14 are removed. The table top 16 may then be rotated about the axis of the fasteners 18 in the holes 78 in the center columns 80 by rotating the edge of the table top 16 having the strip 46 downwardly until the inside bores 72 and 74 become aligned with the holes 78 in the right and left intermediate columns 84 and 86° The fasteners 18 may be inserted through the aligned holes 78 into engagement with the female fasteners 58 and all the fasteners 18 tightened.

The above arrangement permits the use of standard available thicknesses of wood such as ¾" actual thickness for the support portions 48 of the legs 12 and 14 and the main member 20 of the table top 16. The brace members 38 and 40 provide the area at the edge of the table top 16 for locating the vertically spaced female fasteners 58 while maintaining the table at a relatively light weight to permit portability. The width of each brace member 38 and 40 (the dimension in the direction of the width of the main member 20 of the table top 16) need only be enough to permit proper attachment of the female fasteners 56 in their end surfaces 42.

While fastening knobs have been specifically referred to above as the male fastening elements 18, it is possible to use bolt members having a head and a threaded portion with threads that will mate with the internal threads in the female fastener in place of the knobs. In such case, a washer member may be provided between the head of the bolt member and the outside surface of the leg. In the case of the use of either the fastening knobs or bolts, eyelets (not shown), having a generally tubular body and a flange at one end, may be inserted into the holes 78 with the flange positioned against the outside surface 49.

With the above described arrangement, there is provided a table which may be easily assembled at different heights and which has a work surface which can be easily tilted if desired. The table is constructed from a minimum of parts with removable connectors.

While the invention has been described above with reference to a specific embodiment thereof, it is apparent that many changes, modifications, and variations can be made without departing from the concept disclosed herein. Accordingly, it is intended to embrace all such changes, modifications, and variations that fall within the scope of the appended claims.

What is claimed is:

1. An adjustable table comprising:

a. a table top having a top surface and opposed end surfaces, b. female fasteners in each of said end surfaces in two rows spaced apart in a direction perpendicular to said top surface, a first row containing one female fastener and a second row containing four female fasteners, said fasteners in said second row being positioned such that there are two female fasteners on either side of a plane perpendicular to said top surface and containing the female fastener in said first row, c. male fastening members, d. vertical support members having a plurality of apertures therein for receiving a male fastening member therethrough for removable attachment to said female fasteners, said apertures being arranged in five vertically extending columns defining a center column, a left and right outside column and a left and right intermediate column, each column having a plurality of vertically spaced apertures therein, one given aperture in each center column being provided for a given height of said table top, one aperture in each of either said left and right intermediate column or said left and right outside column aligning with a first set of female fasteners in said second row when said top is positioned horizontally for receiving a male fastening member therethrough for releasable attachment to a respective aligned female fastener to secure said table top to said support members with the top surface in a horizontal position, and one aperture in each of the other said left and right intermediate column or said left and right outside column being aligned with a second set of female fasteners in said second row when said table top is tilted for receiving a male fastening member therethrough for releasable attachment to a respective aligned female fastener to secure said table top to said support members with the top surface in a tilted position.

2. The adjustable table of claim 1 wherein for a given height of said table top, an aperture in each of said left and right outside columns aligns with a female fastener in said second row when said table top is horizontal, and an aperture in each of said intermediate columns aligns with a female fastener in said second row said table top is tilted.

3. The adjustable table of claim 2 wherein the position of the apertures in one support member is the mirror image of the position of the apertures in the other support member.

4. The adjustable table of claim 3 wherein an aperture in said left outside column and an aperture in said right outside column used for a given height of said table top are in a horizontal row.

5. The adjustable table of claim 4 wherein for a given aperture in said center column of each support member, an aperture in said right and left intermediate columns is positioned such that it is offset, along a circumference of a circle, through an angle equal to the tilt of said table top, from an intersection of said circumference with the horizontal row containing the apertures in the right and left outside columns used with the given aperture in said center column when said table top is positioned horizontally, said given aperture having an axis, said circle having a center at said axis of said given aperture and a radius equal to the distance from the axis of the female fastener in said first row to the axis of the female fastener in said second row used when said table top is tilted.

6. An adjustable height table comprising a. a table top having opposed side portions and a top surface, b. first and second spaced support members removeably secured to opposite side portions of said table top, c. at least three removable fastener elements for securing and clamping each said support member to a respective side portion, and d. fastener attaching elements secured to said table top for releasably receiving said removable fastener elements to secure said table top to each said support member, each support member having a plurality of vertically spaced sets of apertures therein, each set of apertures having at least three apertures therein, with at least one aperture of each set being spaced vertically from a line containing at least two other apertures of that set, said removable fastener elements adapted to extend through the apertures of one set into engagement with said fastening attaching elements to secure said support member to said table top, each set of apertures in a support member providing for a different height of said table top.

7. The adjustable height table of claim 6 wherein said table top includes a main member extending between said support members and a pair of brace members, one brace member adjacent each support member and attached to said main member, said main member having a bottom side and opposed end surfaces abutting said support members, each of said brace members being attached to said bottom side of said main member and having an end surface abutting said support member, each said main member having secured therein said fastener attaching element adapted to receive said fastener element extending through said at least one aperture, and each said brace member having secured therein said fastener attaching elements adapted to receive said fastener elements extending through said at least two other apertures.

8. The adjustable table of claim 7, wherein each said end surface of said brace members is coplanar with a respective end surface of said main member.

9. The adjustable table of claim 8 wherein each said support member comprises a support portion and a base portion, said base portion having an axis of elongation perpendicular to an axis of the width of the table top between the opposed support members.

10. The adjustable table of claim 6 wherein said table top may be attached to said support members in a tilted position, said table further including a plurality of vertically spaced second sets of at least three apertures in each support member, a second set of fastener attaching elements in said table top for receiving said fastener elements extending through said second set of apertures, said at least three apertures in said second sets being located in said support member in a position such that the table top is tilted when the fastener elements extend therethrough into engagement with a respective fastener attachment element, one of said apertures in said second set being offset with respect to a line containing at least two other apertures of that set.

11. The adjustable table of claim 10 wherein each of said first and second sets of apertures have one aperture in common.

12. The adjustable table of claim 6 wherein said removable fastening elements are male fastening members and said fastener attaching elements are female fastening members.

13. The adjustable table of claim 12 wherein each of said male fastening members includes a knob portion and a threaded male fastening portion extending from said knob portion, and each of said female fastening members includes an internal threaded portion for receiving a threaded male fastening portion, said male fastening portion adapted to extend through an aperture in one of said support members and said knob portion adapted to abut against one of said support members.

* * * * *